US005190159A

United States Patent [19]

Barker

[11] Patent Number: 5,190,159

[45] Date of Patent: Mar. 2, 1993

[54] SELF-CLEANING GRATE MAGNET AND BUSHING

[75] Inventor: Anthony J. Barker, Lake City, Pa.

[73] Assignee: Eriez Manufacturing Company, Erie, Pa.

[21] Appl. No.: 856,305

[22] Filed: Mar. 23, 1992

[51] Int. Cl.[5] ..... B03C 1/00

[52] U.S. Cl. ..... 209/223.2; 209/229; 277/186

[58] Field of Search ..... 209/223.2, 223.1, 228, 209/229; 277/182, 186; 210/222, 223

[56] References Cited

U.S. PATENT DOCUMENTS

| | | | |
|---|---|---|---|
| 1,705,625 | 3/1929 | Mitchell | 403/109 |
| 1,769,268 | 7/1930 | Moyer | 209/228 |
| 1,953,387 | 4/1934 | Benjamin | 403/109 |
| 2,277,703 | 3/1942 | Kennedy et al. | 403/109 |
| 2,733,812 | 2/1956 | Hoff | 209/223.1 |
| 2,792,115 | 5/1957 | Medearis | 209/223.1 |
| 3,866,619 | 2/1975 | Per Frisk | 403/109 |
| 4,150,851 | 4/1979 | Cienfuegos | 403/109 |
| 4,204,948 | 5/1980 | Wechsler et al. | 209/223.1 |
| 4,394,264 | 7/1983 | Schimion et al. | 209/229 |
| 4,401,307 | 8/1983 | Dechavanne | 277/186 |
| 4,457,838 | 7/1984 | Carr | 209/223.2 |
| 4,867,869 | 9/1989 | Barrett | 209/223.2 |

*Primary Examiner*—H. Grant Skaggs

*Attorney, Agent, or Firm*—Lovercheck and Lovercheck

[57] ABSTRACT

A self-cleaning grate magnet made up of an enclosure having a discharge duct adjacent a product duct separated by a partition and a magnet tube frame having magnetic tubes fixed thereto. The magnetic tubes extend through first holes in the enclosure, the discharge duct and through second larger holes in the partition and into the product duct where the magnetic tubes collect ferrous material on their surface. Wiper bushings are slidably received on the magnetic tubes and disposed in the discharge duct. The wiper bushings are too large to pass through the second holes in the enclosure in the partition. The holes in the partition between the discharge duct and the product duct are substantially larger than the magnetic tubes so that ferrous material is carried by the magnetic tubes into the discharge duct. The wiper bushings are stopped by the discharge duct walls and wipe the ferrous material from the magnetic tubes as the magnetic tubes are pulled through the product duct. The wiper bushings have wiper rings having a unique shape that provides improved cleaning action.

15 Claims, 3 Drawing Sheets

SELF-CLEANING GRATE MAGNET AND BUSHING

BACKGROUND OF THE INVENTION

This application relates to grate magnets having magnetic tubes and more particularly to a self-cleaning grate magnet having a floating bushing to wipe ferrous material from magnetic tubes.

Applicant is aware of the following U.S. Patents:

U.S. Pat. No. 1,705,625; U.S. Pat. No. 1,953,387; U.S. Pat. No. 2,277,703; U.S. Pat. No. 2,733,812; U.S. Pat. No. 2,792,115; U.S. Pat. No. 3,866,619; and, U.S. Pat. No. 4,150,851. None of these patents disclose the invention claimed in the invention of the present application.

U.S. Pat. No. 4,867,869 to Barrett shows a self-cleaning grate magnet wherein non-magnetic tubes have magnetic tubes in them. The non-magnetic tubes are supported like a drawer in a duct across an open frame. A product flows through the open frame. The magnetic tubes attract ferrous material from the product to the non-magnetic tubes. To clean the ferrous material from the non-magnetic tubes, the drawer is withdrawn from the duct and the magnetic tubes are then withdrawn from the non-magnetic tubes, thereby releasing the ferrous material from the non-magnetic tubes.

Applicant is also aware of a prior art self-cleaning grate magnet wherein magnetic tubes are supported across a duct and withdrawn through wiper bushings that are fixed on the remote side of a discharge area of the discharge duct so that the wiper bushing wipes ferrous material from the magnetic tubes.

SUMMARY OF THE INVENTION

Applicant has discovered that in a self-cleaning grate magnet wherein magnetic tubes are supported in a duct and withdrawn through a wiper bushing in a discharge area, the operation of the grate magnet can be improved by allowing the wiper bushings to float on the magnetic tubes from a hole plug position to cleaning position. In operation, when the magnetic tubes are pulled a first distance, the wiper bushings move with the magnetic tubes until the wiper bushings are moved to the cleaning position against the remote wall of the discharge area where the wiper bushings stop. As the magnetic tubes continue to move, the wiper bushings wipe the ferrous material from the remainder of the magnetic tube as the magnetic tube is further withdrawn from the product area. After the magnetic tubes are fully withdrawn from the product area, the magnetic tubes are pushed back into the product area. The wiper bushings first move with the magnetic tubes until the wiper bushings engage the intermediate partition between the discharge area and the product area. The magnetic tubes then slide through the wiper bushings into the product area to gather more ferrous material.

It is an object of the invention to provide an improved self-cleaning grate magnet.

Another object of the invention is to provide an improved tube wiper bushing.

Another object of the invention is to provide a self-cleaning grate that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

DESCRIPTION OF THE PREFERRED EMBODIMENT(S)

Figure 1:
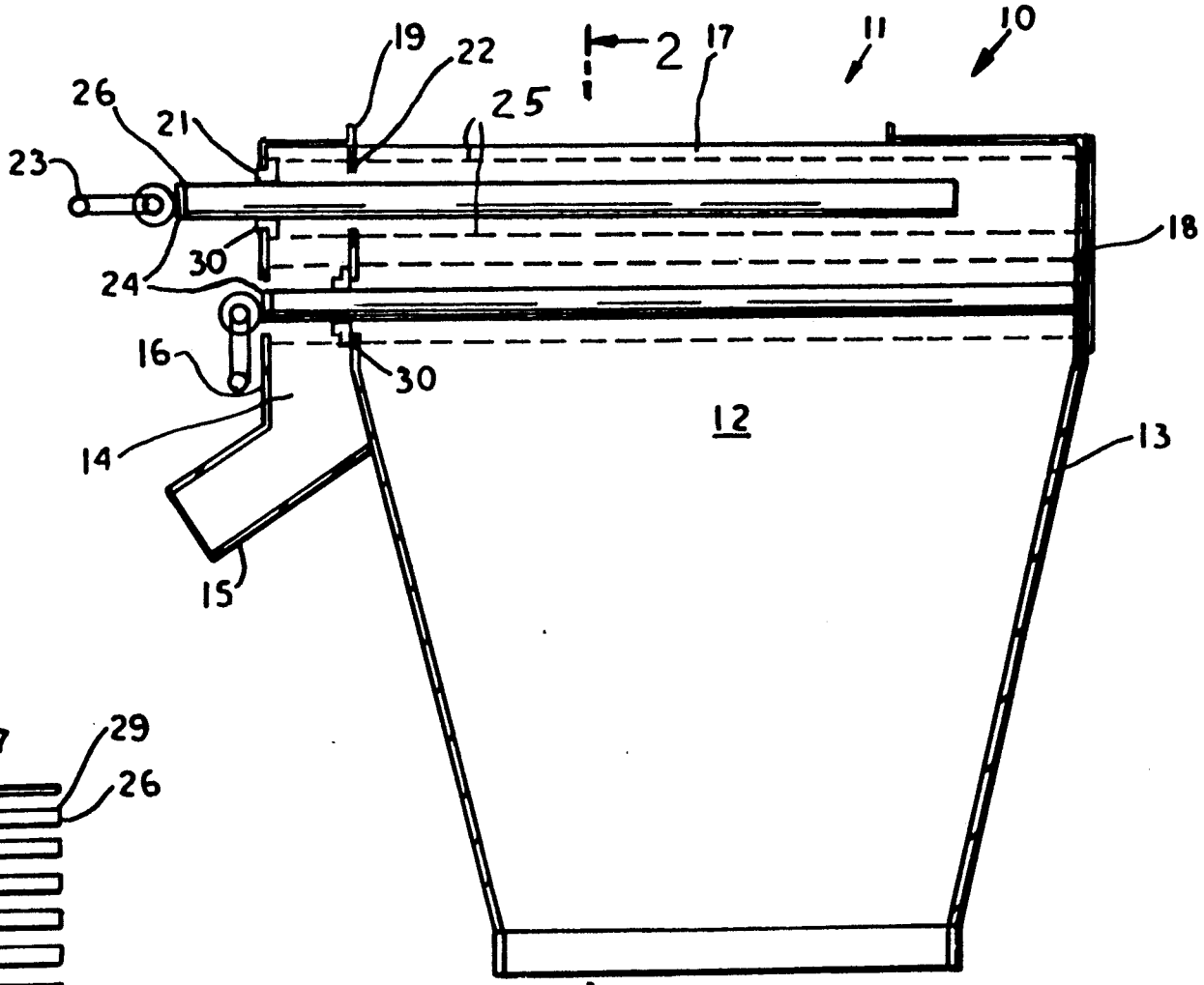
FIG. 1 is a side view, partly in cross section, taken on line 1—1 of FIG. 2, of a self-cleaning grate magnet showing the lower magnetic tubes in a use position and the upper magnetic tubes moved to the tube cleaning position.
Figure 7:
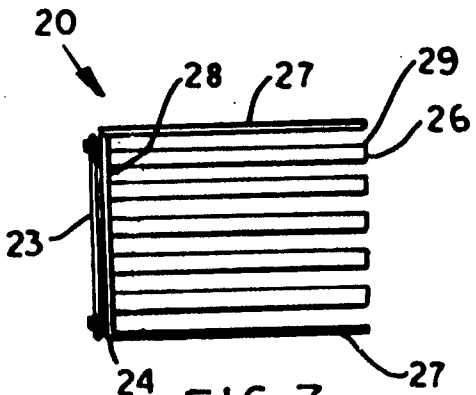
FIG. 7 is a top view of the tube support frame and magnetic tubes.
Figure 2:
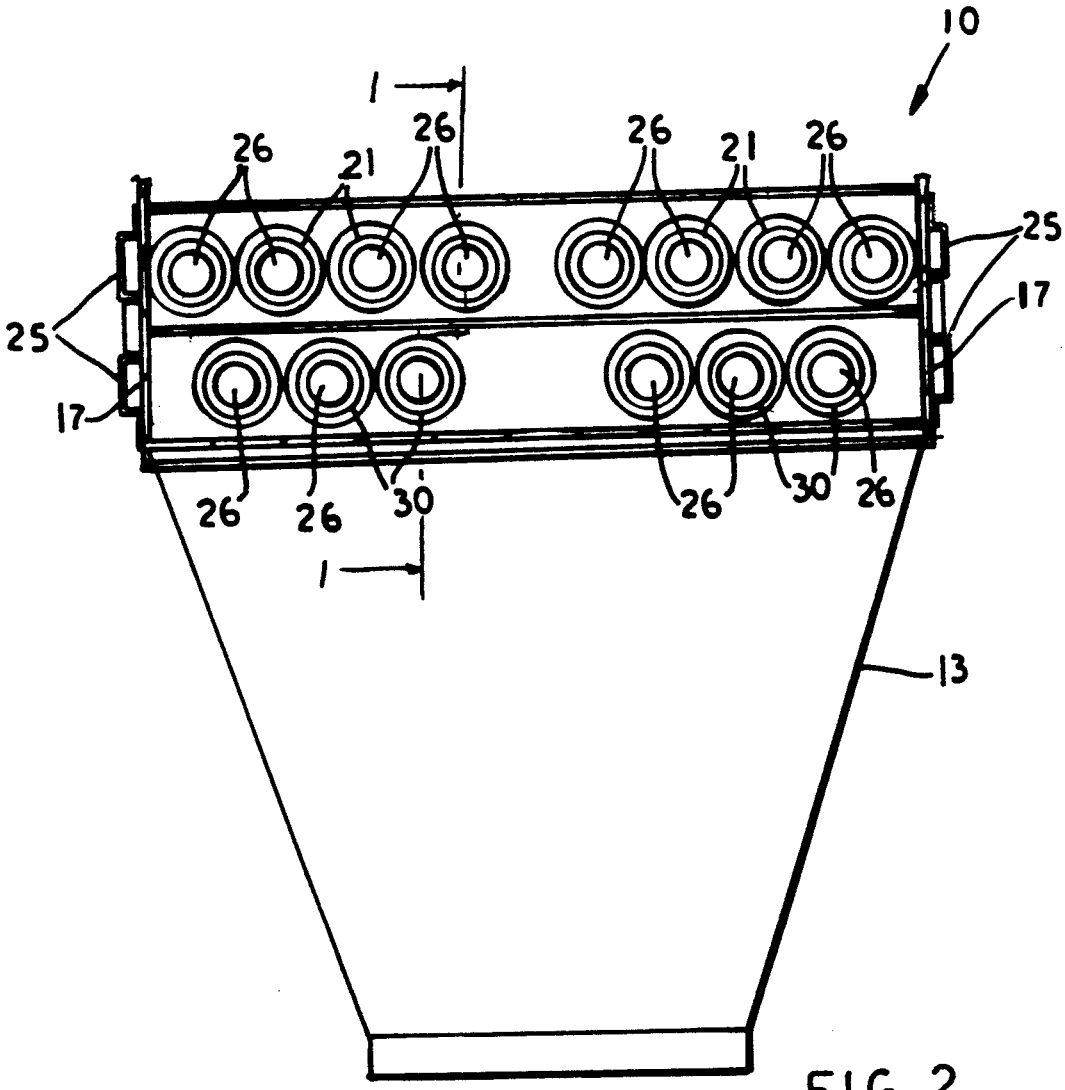
FIG. 2 is a cross sectional view taken on line 2—2 of FIG. 1 of the grate magnet.
Figure 3:
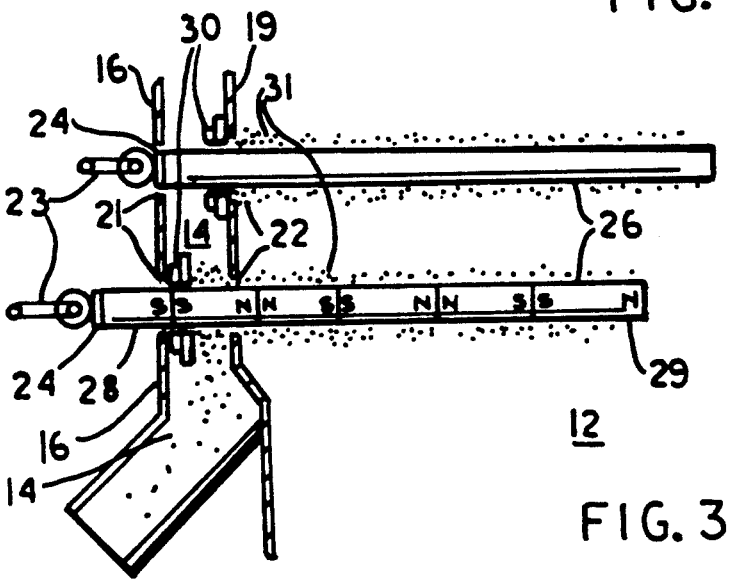
FIG. 3 is an enlarged partial view of the self-cleaning grate magnet shown in FIG. 1.
Figure 5:
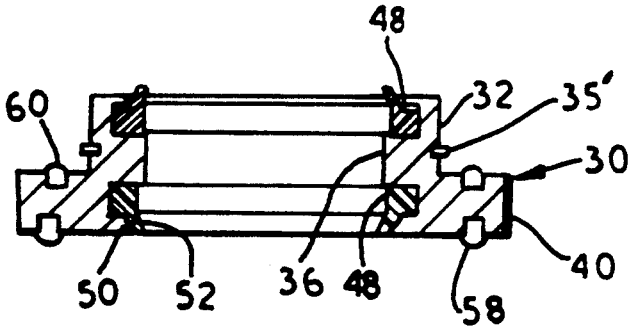
FIG. 5 is a longitudinal cross sectional view taken on line 5—5 of FIG. 4 of the wiper bushing.
Figure 6:
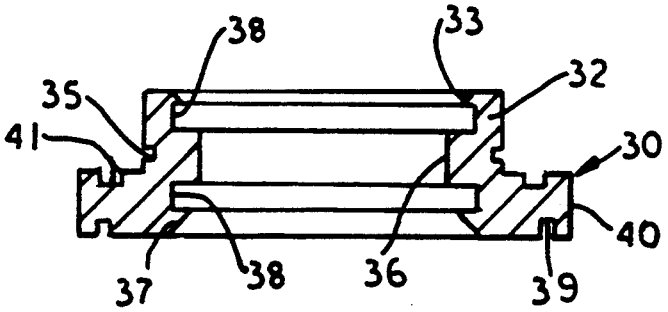
FIG. 6 is view similar to FIG. 5 of the wiper bushing with the wiper ring removed.
Figure 8:
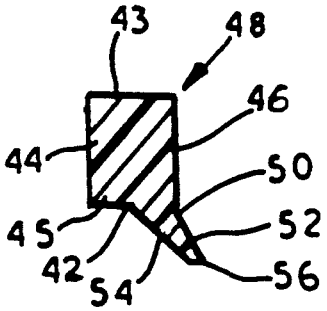
FIG. 8 is an enlarged partial cross sectional view of the wiper ring shown in FIG. 5.
Figure 4:
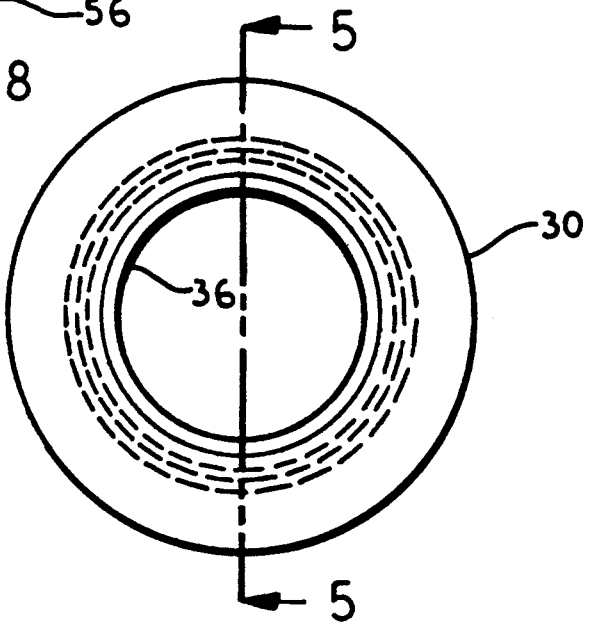
FIG. 4 is a bottom view of the wiper bushing.

Now with more particular reference to the drawings, self-cleaning grate magnet 10 has enclosure 11, which encloses product area 12 and discharge area 14. Product area 12 is enclosed by product duct 13. Discharge area 14 is enclosed by discharge duct 15. Enclosure 11 has first end 16, spaced side members 17, second end 18 and intermediate partition 19 separating product area 12 from discharge area 14. First end 16, second end 18 and intermediate partition 19 have their ends fixed to spaced side members 17. First end 16 has first spaced holes 21 aligned with larger second spaced holes 22 in said intermediate partition 19.

Magnetic assemblies 20 have handles 23 swingably attached thereto for convenience in pulling elongated cylindrical magnetic tubes 26 out of product area 12 and through annular wiper bushings 30 in discharge area 14. Magnetic assemblies 20 are carried by support rails 27 which are slidably received in support rail tracks 25. Support rail tracks 25 are attached to side members 17 and receive support rails 27 on magnetic assemblies 20.

Each magnetic tube 26 has first tube end 28 and second tube end 29. Magnetic tubes 26 are attached to tube support frame 24 and extend through first spaced holes 21 and through second spaced holes 22 into product area 12 to attract ferrous material 31 from a product flowing through product duct 13. Second spaced holes 22 are large enough to allow ferrous material 31 attracted to magnetic tubes 26 to move through second holes 22 into discharge area 14.

Annular wiper bushings 30 have a generally cylindrical body 32 with cylindrical bore 36 therethrough to slidably receive magnetic tubes 26. Each annular wiper bushing 30 has flange 40. Groove 35 in cylindrical body 32 receives snap ring 35'. Cylindrical bore 36 has countersinks 33,37. Spaced internal grooves 38 are formed in cylindrical body 32. External grooves 39,41, for O-rings 58,60 are formed in flange 40. Annular wiper rings 48 are supported in spaced internal grooves 38. Each annular wiper ring 48 has inner side 43, outer periphery 44, outer side 45, inner periphery 46 and axially and radially extending integrally attached lip 50. Outer side 45 has intermediate part 42.

Lip 50 is wedge-shaped in cross section and has inner periphery 52 and outer periphery 54 and terminates in a relatively thin edge 56. Thin edge 56 engages and slides along magnetic tubes 26 thereby wiping ferrous material 31 from magnetic tubes 26. Outer periphery 54 of lip 50 is clear of countersinks 33,37. Lips 50 extend from annular wiper rings 48 in opposite directions from one another so that one or the other is always pointing in the direction of travel of magnetic tubes 26.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A self-cleaning grate magnet comprising a first end and an intermediate partition disposed in spaced relation to one another defining a discharge area;

a product area adjacent said discharge area;

a first hole in said first end aligned with a second hole in said intermediate partition;

a magnetic tube attached to a tube support frame and extending through said first hole and through said second hole into said product area to attract ferrous material from a product flowing through said product area;

said second hole being substantially larger than said magnetic tube thereby allowing said ferrous material to be drawn into said discharge area;

an annular wiper bushing;

said annular wiper bushing being disposed on said magnetic tube between said first end and said intermediate partition said magnetic tube being adapted to be pulled through said first hole and through said second hole in said intermediate partition pulling said annular wiper bushing against said first end thereby stopping said annular wiper bushing;

said magnetic tube being adapted to be further pulled through said first holes, through said second holes and through said annular wiper bushing whereby said ferrous material is wiped from said magnetic tube in said discharge area;

said magnetic tube being adapted to be pushed back through said first hole and through said second hole carrying said annular wiper bushing into engagement with said intermediate partition whereby said annular wiper bushing is stopped and said magnetic tube is further pushed through said annular wiper bushing into said product area.

2. The self-cleaning grate magnet recited in claim 1 wherein a plurality of magnetic tubes are attached to said tube support frame;

a plurality of annular wiper bushings are received on said magnetic tubes;

a plurality of first holes are formed in said first end and a plurality of second holes are formed in said intermediate partition.

3. The self-cleaning grate magnet recited in claim 2 wherein said discharge area is disposed in a discharge duct and said product area is disposed in a product duct.

4. The self-cleaning grate magnet recited in claim 2 wherein said annular wiper bushings have outwardly directed flanges larger than said second spaced holes in said intermediate partition;

said annular wiper bushings being larger than said second spaced holes whereby said annular wiper bushings are adapted to be stopped by said intermediate partition.

5. The self-cleaning grate magnet recited in claim 4 wherein said annular wiper bushings have a generally cylindrical body;

said cylindrical body having axially spaced internal circumferential grooves;

each said internal circumferential groove being adapted to receive an annular wiper ring;

each said annular wiper ring having an integral lip thereon;

said lip, being wedge shaped in cross section, extending inwardly from said annular wiper ring and terminating in a relatively thin edge; and, said thin edge being adapted to engage said magnetic tubes.

6. The self-cleaning grate magnet recited in claim 5 wherein said annular wiper rings are generally rectangular in cross section and said lips are integrally attached to an outer side of said annular wiper ring.

7. The self-cleaning grate magnet recited in claim 6 wheein said lips have an inner periphery forming an extension of said inner periphery of said annular wiper ring;

said lips each have an outer periphery extending from an intermediate part of an outer side of said annular wiper ring;

said outer periphery of said lip joining said inner periphery of said lip at said thin edge.

8. The self-cleaning grate magnet recited in claim 1 wherein spaced side members are fixed to said first end and to said intermediate partition and tracks are attached to said side members for receiving support rails attached to said tube support frame.

9. A self-cleaning grate magnet comprising an enclosure including a product area and a discharge area;

laterally spaced side members;

a first end and an intermediate partition longitudinally spaced from said first end fixed to said side members and defining said discharge area therebetween;

said intermediate partition being disposed between said discharge area and said product area and said product area being adapted to receive ferrous material;

first holes in said first end;

second holes in said intermediate partition;

magnetic tubes each having a first tube end and a second tube end;

a tube support frame fixed to said first tube ends of said magnetic tubes;

said magnetic tubes being received in said first holes and in said second holes and extending through said discharge area into said product area where said ferrous material adheres to said magnetic tubes;

annular wiper bushings slidably supported on said magnetic tubes and disposed between said first end and said intermediate partition;

said second holes being larger than said magnetic tubes;

said ferrous material adhering to said magnetic tubes and being adapted to be removed by said annular wiper bushings when said tube support frame is pulled away from said first end thereby first pulling said annular wiper bushings with said magnetic tubes into engagement with said first end and stopping said annular wiper bushings;

said magnetic tubes being adapted to slide through said annular wiper bushings whereby said ferrous material is wiped from said magnetic tubes and into said discharge area;

said tube support frame being adapted to move said annular wiper bushings back into engagement with said intermediate partition whereby said annular wiper bushings are stopped and said magnetic tubes move through said annular wiper bushings through said product area.

10. The self-cleaning grate magnet recited in claim 9 wherein two said tube support frames are provided;

each said tube support frame has a plurality of said magnetic tubes fixed thereto;

tracks means supported on said side members of said enclosure;

each said tube support frame being supported on said track means one above the other on said self-cleaning grate magnet.

11. An annular wiper bushing for wiping a magnetic tube comprising a hollow cylindrical body;

said cylindrical body having a cylindrical bore;

said cylindrical bore having countersinks;

two spaced internal annular grooves in said cylindrical body;

one said internal annular groove being adjacent a first bushing end of said cylindrical bore and one said internal annular groove adjacent a second bushing end of a cylindrical bore;

an annular wiper ring in said each said spaced internal groove;

said annular wiper ring being generally rectangular in cross section;

said annular wiper ring having a lip integrally attached thereto;

said annular wiper ring having an inner side, an outer periphery, an outer side with an intermediate part and an inner periphery;

said lip having an inner periphery and an outer periphery;

said inner periphery of said lip substantially forming a continuation of said inner periphery of said annular wiper ring;

said outer periphery of said lip adapted to be clear of said countersinks and joining said outer side of said annular wiper ring at said intermediate part.

12. The annular wiper bushing recited in claim 11 wherein said inner periphery of said lip inclines toward a central axis of said cylindrical body.

13. The annular wiper bushing recited in claim 11 wherein said cylindrical body has an outwardly directed s flange fixed to one end thereof.

14. The annular wiper bushing recited in claim 13 wherein laterally disposed external grooves are formed in said flange and said external grooves being adapted to have resilient rings disposed thereon to act as bumpers to engage said first end and said intermediate partition.

15. In combination a magnetic tube and an annular wiper bushing;

an enclosure having a first end, an intermediate partition separating a product area from a discharge area;

a first hole in said first end and a second hole large enough to pass material adhering to said magnetic tube in said intermediate partition;

said magnetic tube adapted to extend through said first hole and through said second hole;

said annular wiper bushing disposed on said magnetic tube;

said annular wiper bushing having a cylindrical body and an outwardly directed flange;

said cylindrical body being received in said first hole;

said flange being adapted to engage said first end when said magnetic tube is pulled toward said first end;

said flange being adapted to engage said second hole when said magnetic tube is pushed toward said intermediate partition whereby ferrous material adhering to said magnetic tube is wiped from said magnetic tube when said magnetic tube is pulled from said product area;

said flange being adapted to engage said intermediate partition when said magnetic tube is pushed back into said product area.

* * * * *